US009615672B2

(12) United States Patent
Weisbeck et al.

(10) Patent No.: US 9,615,672 B2
(45) Date of Patent: Apr. 11, 2017

(54) GATE FOR PLAY YARD

(71) Applicant: North States Industries, Inc., Blaine, MN (US)

(72) Inventors: Dean Weisbeck, Medina, MN (US); Julie Ann Yager Grad, Deephaven, MN (US)

(73) Assignee: North States Industries, Inc., Blaine, MN (US)

( * ) Notice: Subject to any disclaimer, the term of this patent is extended or adjusted under 35 U.S.C. 154(b) by 87 days.

(21) Appl. No.: 14/017,552

(22) Filed: Sep. 4, 2013

(65) Prior Publication Data

US 2014/0061563 A1 Mar. 6, 2014

Related U.S. Application Data

(60) Provisional application No. 61/696,635, filed on Sep. 4, 2012.

(51) Int. Cl.
*A47D 13/06* (2006.01)

(52) U.S. Cl.
CPC ..... *A47D 13/06* (2013.01); *A47D 13/066* (2013.01)

(58) Field of Classification Search
CPC .. A47D 13/06; A47D 13/066; E05B 65/0007; E05B 65/0014; E05B 55/00; E05B 55/06; E05B 55/12; E05C 1/14; E05C 1/145; E05C 1/08; E06B 11/02; E06B 2009/002
USPC ..... 256/25, 73
See application file for complete search history.

(56) References Cited

U.S. PATENT DOCUMENTS

| | | | | |
|---|---|---|---|---|
| 3,021,116 | A | 2/1962 | Querengesser | |
| 4,628,635 | A | 12/1986 | Maillard | |
| 5,544,870 | A | 8/1996 | Kelley et al. | |
| 6,027,104 | A * | 2/2000 | Alexander et al. | 256/25 |
| D422,367 | S | 4/2000 | Mishina | |
| 6,112,461 | A * | 9/2000 | Cheng | 49/55 |
| 6,123,321 | A * | 9/2000 | Miller | 256/25 |
| 6,164,013 | A | 12/2000 | Ramsey | |
| 6,425,609 | B2 * | 7/2002 | Cheng | E05B 65/0007 292/5 |
| 6,446,395 | B2 | 9/2002 | Rogers | |
| 7,152,372 | B2 * | 12/2006 | Cheng | E05C 1/06 49/465 |
| 7,207,141 | B2 | 4/2007 | Sullivan | |
| 7,284,502 | B1 | 10/2007 | Dotter | |
| 7,334,624 | B2 * | 2/2008 | Waldman | E05B 17/2053 160/144 |

(Continued)

OTHER PUBLICATIONS

PetSmart, "Extra Tall Flexi Metal Walk-Through Gate w/Small Pet Door and Extensions," © 1999-2013, 3 pages.

(Continued)

*Primary Examiner* — Matthieu F Setliff
(74) *Attorney, Agent, or Firm* — Merchant & Gould P.C.

(57) ABSTRACT

A play yard can include a plurality of side panels that are connected to one another and a gate panel connected to two of the side panels to create an enclosed space. The gate panel can include a panel frame that defines an opening and a gate that can be mounted to the panel frame in the opening to swing from a closed position to an open position. The gate panel can include a first locking mechanism on the gate to hold the gate in the closed position and a second locking mechanism on the gate to hold the gate in the closed position.

18 Claims, 25 Drawing Sheets

(56) References Cited

U.S. PATENT DOCUMENTS

| | | | | |
|---|---|---|---|---|
| 7,373,755 | B2 * | 5/2008 | Jefferys | E05F 1/066 49/394 |
| D577,465 | S | 9/2008 | Eren | |
| 7,481,471 | B2 | 1/2009 | Andersen et al. | |
| D608,019 | S | 1/2010 | Arden | |
| 7,887,029 | B2 | 2/2011 | Flannery | |
| 8,141,517 | B2 | 3/2012 | Shimoda et al. | |
| 8,176,962 | B2 | 5/2012 | Kilfoyle | |
| 8,286,591 | B2 | 10/2012 | Moffett-Chaney et al. | |
| 8,555,434 | B2 * | 10/2013 | Chapman et al. | 5/93.2 |
| 9,097,050 | B2 * | 8/2015 | Yates | E05B 65/0007 |
| 2004/0045222 | A1 * | 3/2004 | Hicks | E05F 1/066 49/394 |
| 2004/0239122 | A1 * | 12/2004 | Thompson | 292/67 |
| 2006/0055182 | A1 * | 3/2006 | Jefferys | E05F 1/066 292/251.5 |
| 2006/0081826 | A1 * | 4/2006 | Cheng | 256/22 |
| 2006/0169217 | A1 | 8/2006 | Glassford | |
| 2006/0175028 | A1 * | 8/2006 | Askinasi | 160/225 |
| 2006/0207180 | A1 * | 9/2006 | Cheng | 49/57 |
| 2008/0185566 | A1 * | 8/2008 | Flannery | 256/73 |
| 2008/0265233 | A1 * | 10/2008 | Flannery | 256/73 |
| 2009/0013604 | A1 * | 1/2009 | Yates | 49/49 |
| 2011/0253963 | A1 * | 10/2011 | Hsieh et al. | 256/25 |
| 2012/0011775 | A1 * | 1/2012 | Chen | 49/358 |
| 2012/0235101 | A1 | 9/2012 | Flannery et al. | |
| 2012/0256148 | A1 * | 10/2012 | Sirotin et al. | 256/25 |
| 2013/0118088 | A1 * | 5/2013 | Yates | E05B 65/0007 49/386 |

OTHER PUBLICATIONS

PetSmart, "Iris 8 Panel Pet Containment Pen with door," © 1999-2013, 2 pages.

PetSmart, "Precision Pet Exercise Pen with Door—48" © 1999-2013, 2 pages.

PetSmart, "Primetime Petz Auto Close Pet Gate w/ Sub Door," © 1999-2013, 2 pages.

PetSmart, "Step-Over Mini Gate with Pet Door," © 1999-2013, 3 pages.

PetSmart, "Top Pawn™ Extra-Wide Metal Walk Through Pet Gate," © 1999-2013, 3 pages.

Primetime PETZ, "360° Configurable Gate w Door," © 2013, 4 pages.

Safety 1st®, "Baby & Pet Gate," © 2013, 4 pages.

* cited by examiner

GATE FOR PLAY YARD

BACKGROUND

A play yard forms an enclosed space in which young children and/or animals can be placed for security and safety. A typical play yard is made up of several panels and is self-supporting. To enter and exit the play yard, it can be necessary to step over the play yard panels or unhook two of the panels to form a space. Both such actions can be difficult, particularly when carrying a larger child or animal into or out of the play yard.

SUMMARY

In one aspect, a play yard includes: a plurality of side panels coupled to one another; a gate panel coupled to two of the plurality of side panels to create an enclosed space, the gate panel including: a panel frame defining an opening; a gate mounted to the panel frame in the opening to swing from a closed position to an open position; a first locking mechanism on the gate to hold the gate in the closed position; and a second locking mechanism on the gate frame to hold the gate in the closed position.

In another aspect, a play yard includes: a plurality of side panels coupled to one another; a gate panel coupled to two of the plurality of side panels to create an enclosed space, the gate panel including: a panel frame including a panel base member and side members that define an opening; a gate mounted to the panel frame in the opening to swing from a closed position to an open position; a first locking mechanism on the gate to hold the gate in the closed position, the first locking mechanism including a hook member sized to engage an opening defined by the panel frame; and a second locking mechanism on the gate to hold the gate in the closed position, the second locking mechanism including a switch configured to move between locked and unlocked positions; wherein the gate is configured to be opened by allowing the second locking mechanism to be moved to the unlocked position, and the gate being thereupon moveable upwardly away from the panel base member to allow the hook member to disengage the opening of the panel frame.

In yet another aspect, a method for using a play yard includes: assembling a plurality of side panels and a gate panel including a gate to form an enclosed space; moving a first locking mechanism from a locked position to an unlocked position; lifting the gate in the gate panel to clear a second locking mechanism; and swinging the gate from a closed position to an open position.

DETAILED DESCRIPTION

The present disclosure is directed towards a gate for a play yard. Examples are provided herein. However, the disclosure is not limited to the examples.

Figure 1:
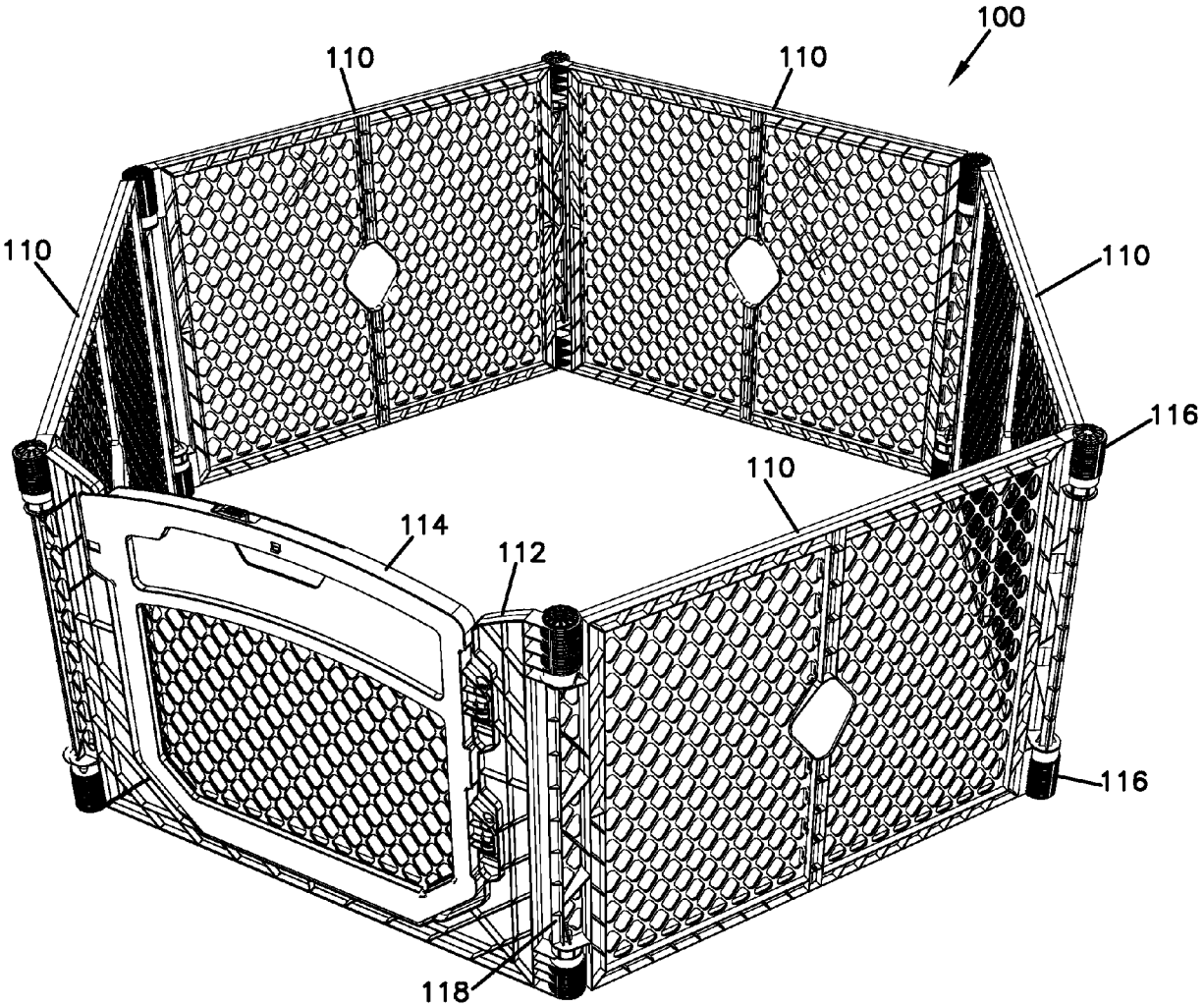
FIG. 1 is a front perspective view of an example play yard.
Figure 2:
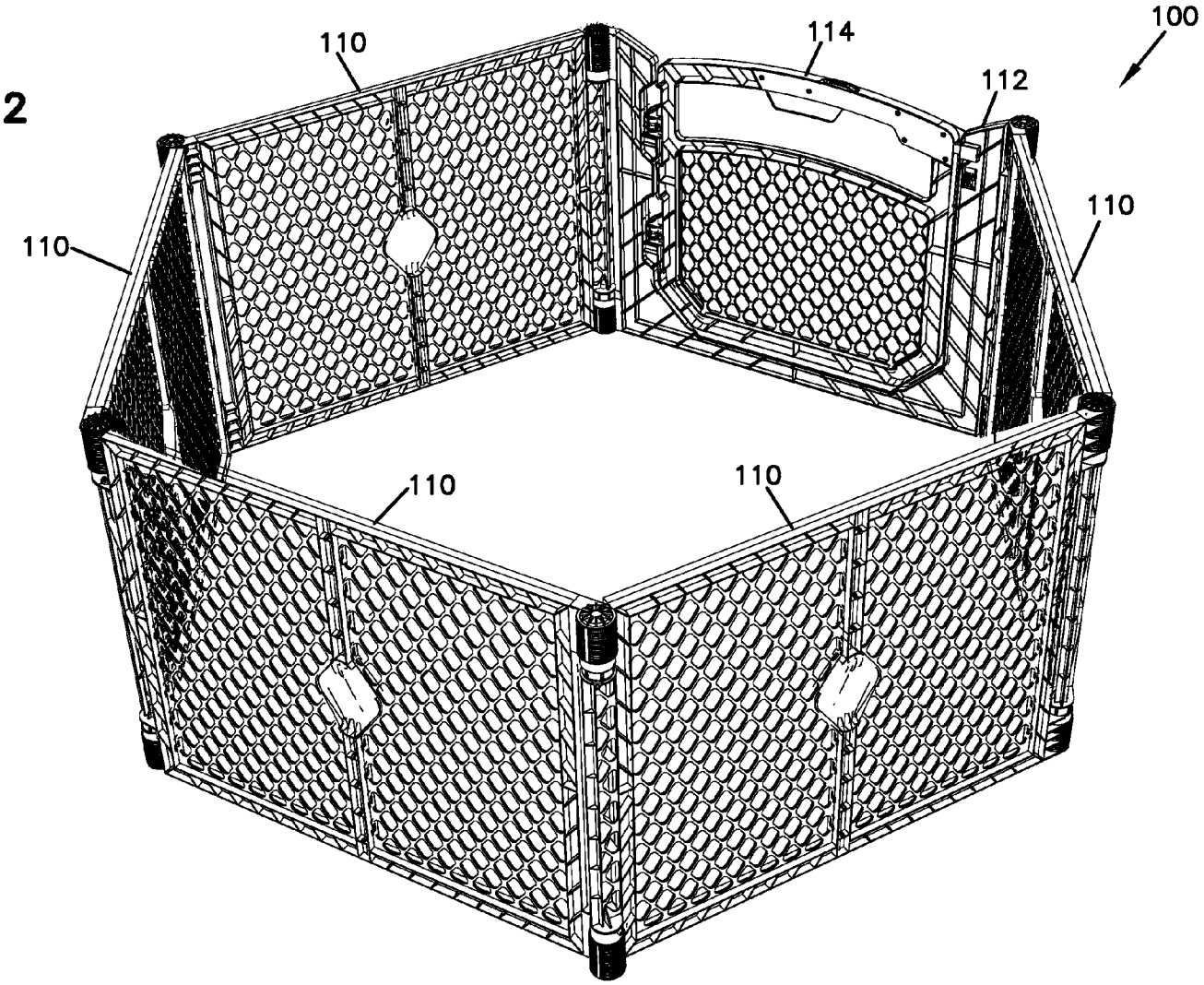
FIG. 2 is a back perspective view of the play yard of FIG. 1.
Figure 3:
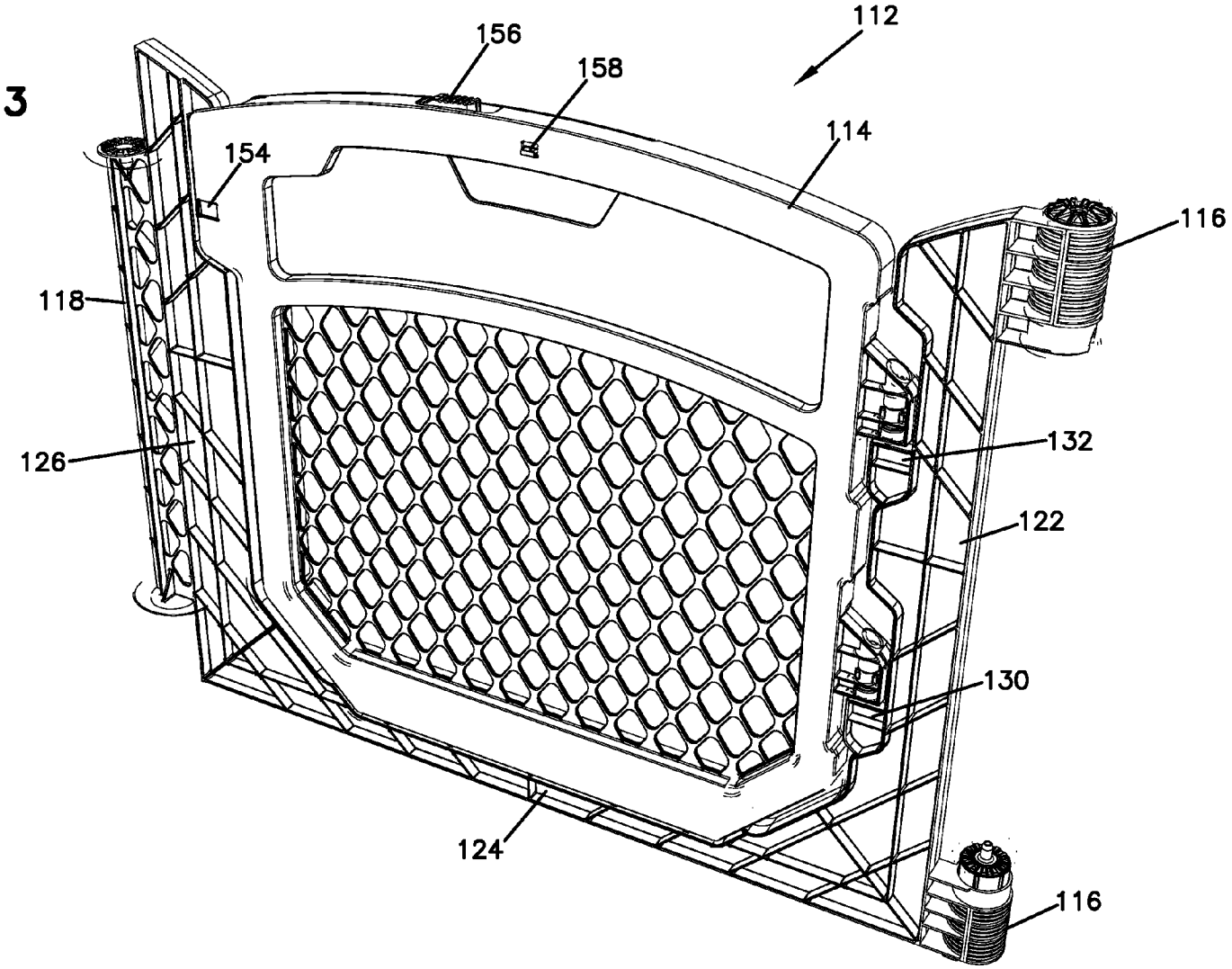
FIG. 3 is a front perspective view of an example gate panel of the play yard of FIG. 1 with the gate in the closed position.
Figure 4:
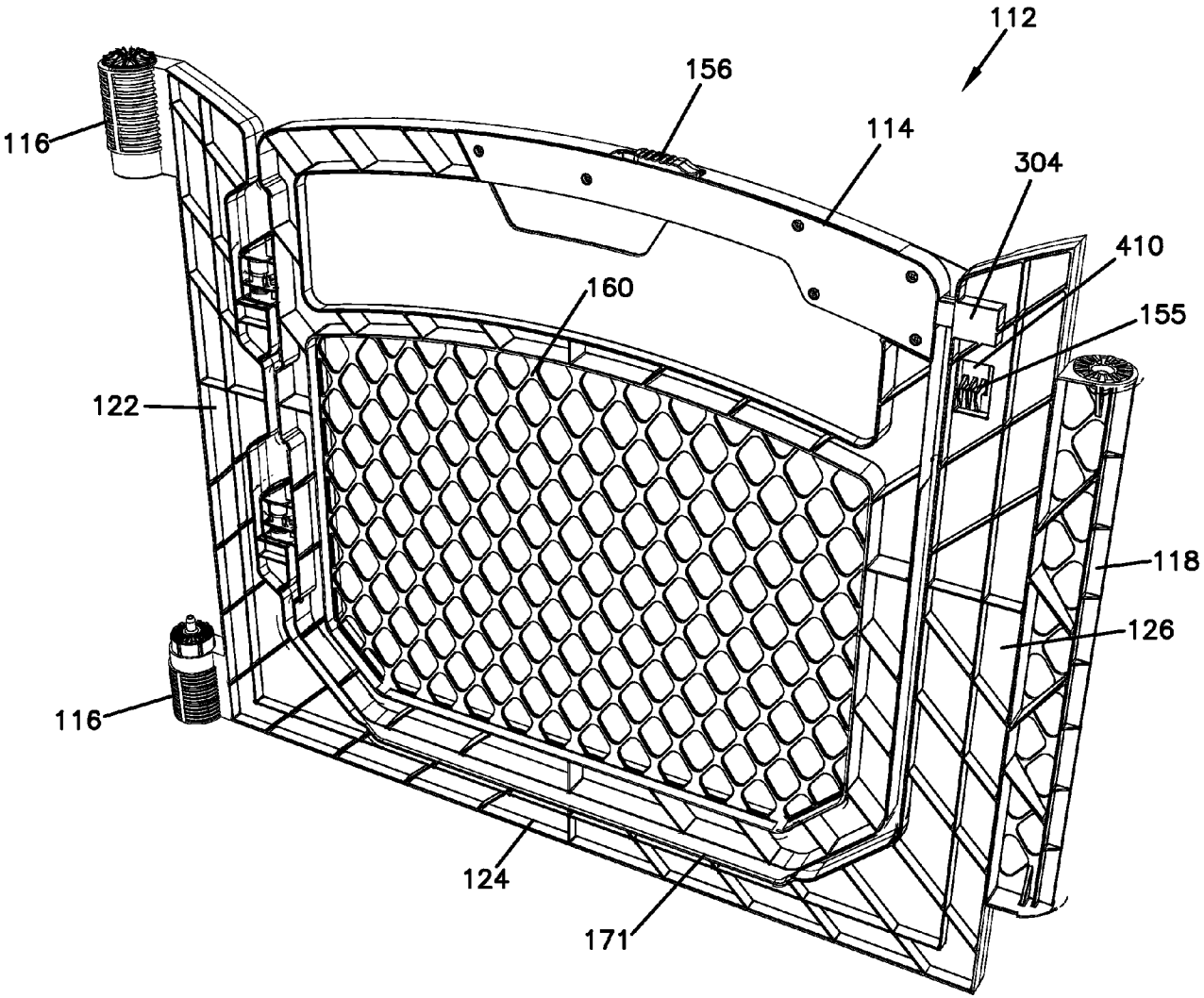
FIG. 4 is a back perspective view of the gate panel of FIG. 3.
Figure 5:
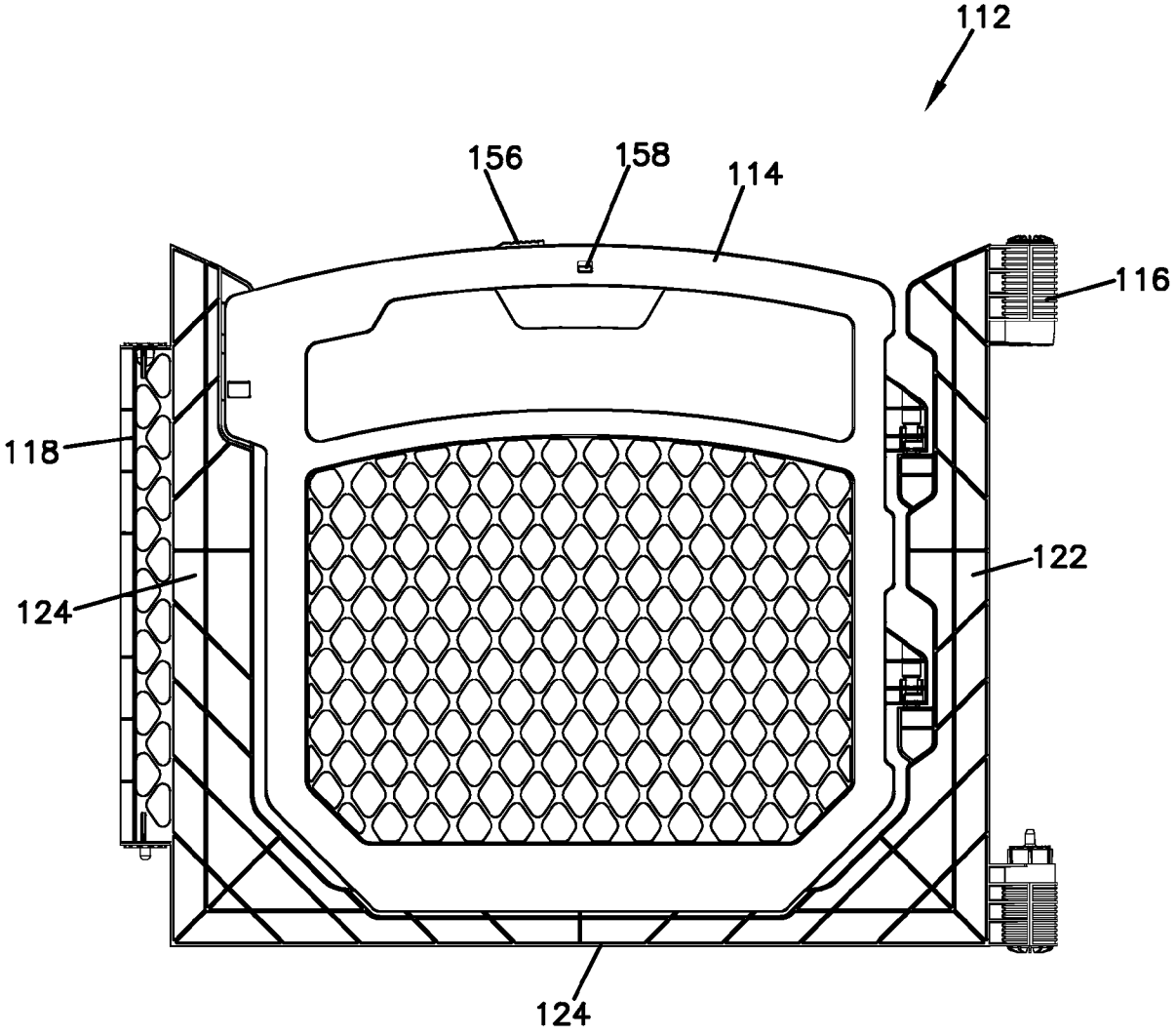
FIG. 5 is a front view of the gate panel of FIG. 3.
Figure 6:
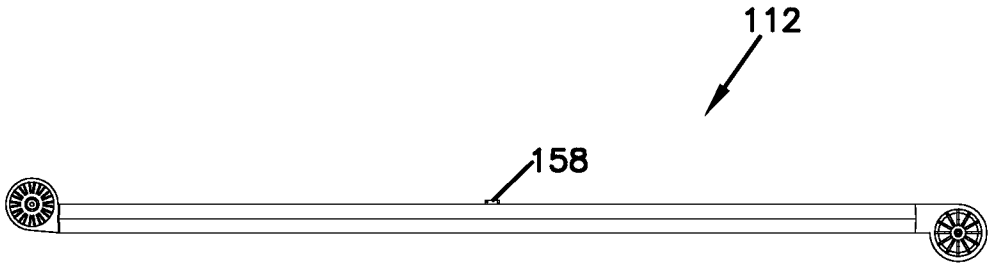
FIG. 6 is a bottom view of the gate panel of FIG. 3.
Figure 7:
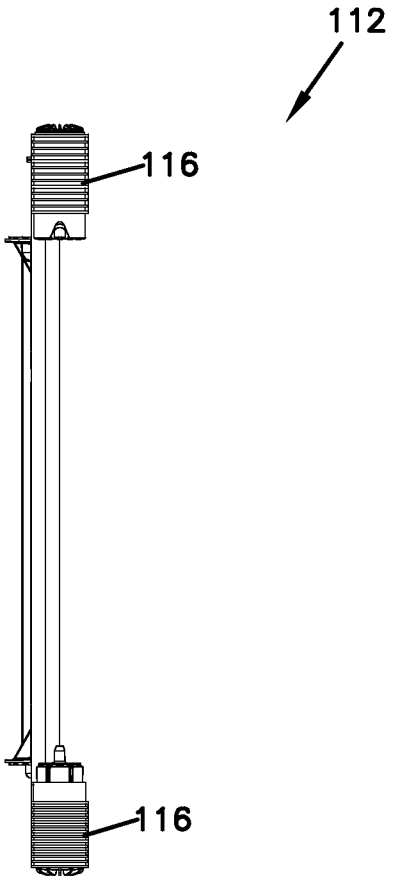
FIG. 7 is a side view of the gate panel of FIG. 3.
Figure 8:
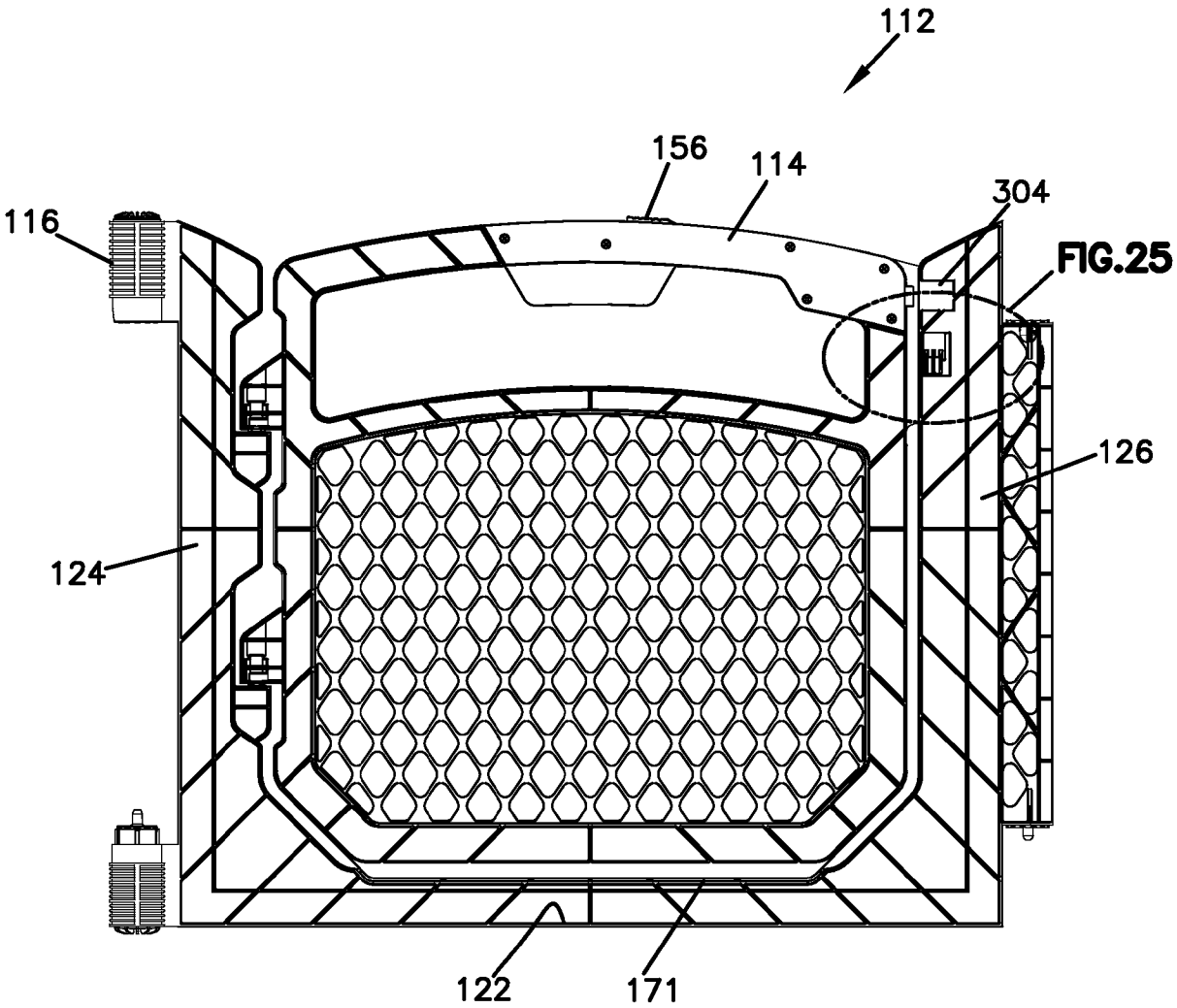
FIG. 8 is a back view of the gate panel of FIG. 3.
Figure 9:
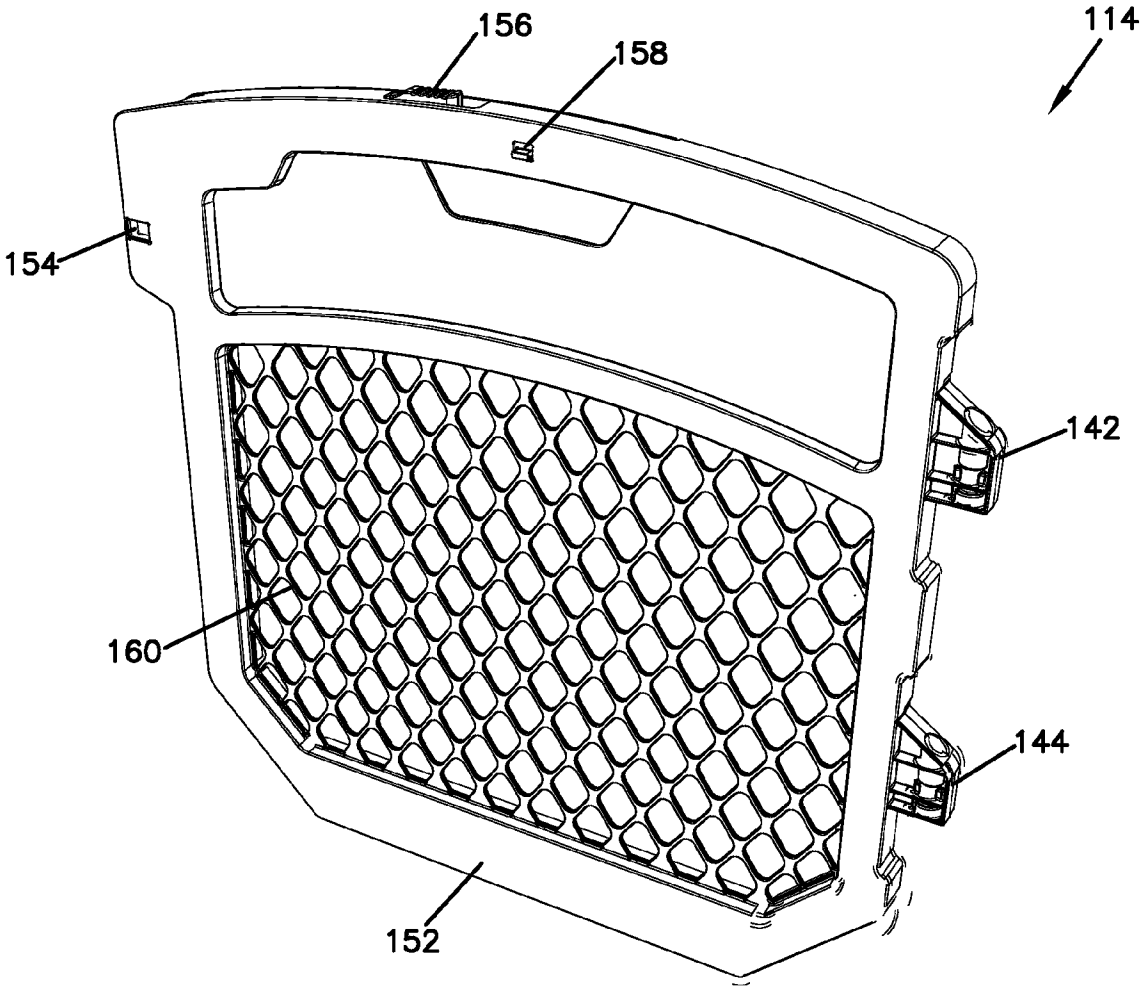
FIG. 9 is a front perspective view of an example gate of the gate panel of FIG. 3.
Figure 10:
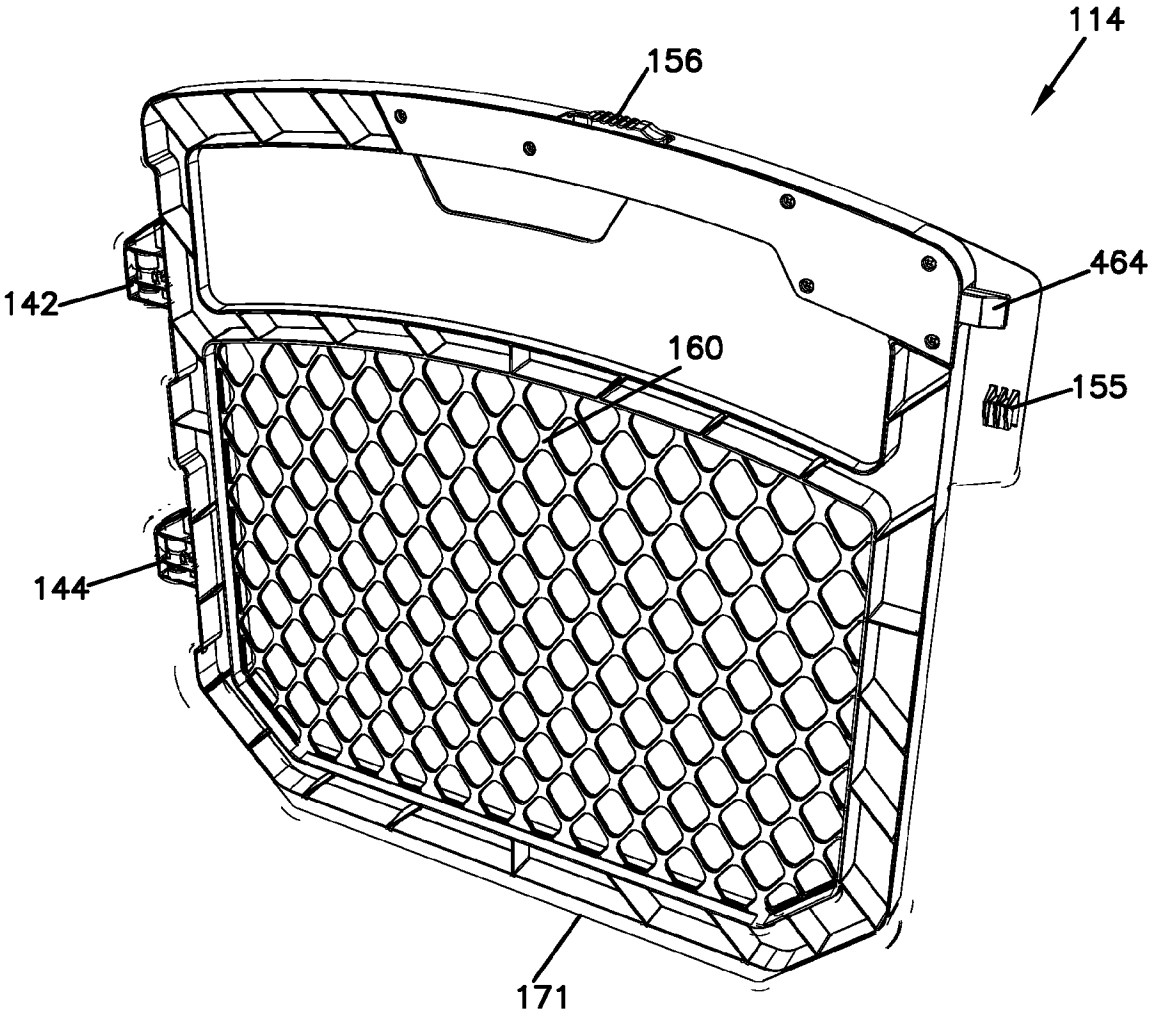
FIG. 10 is a back perspective view of the gate of FIG. 9.
Figure 11:
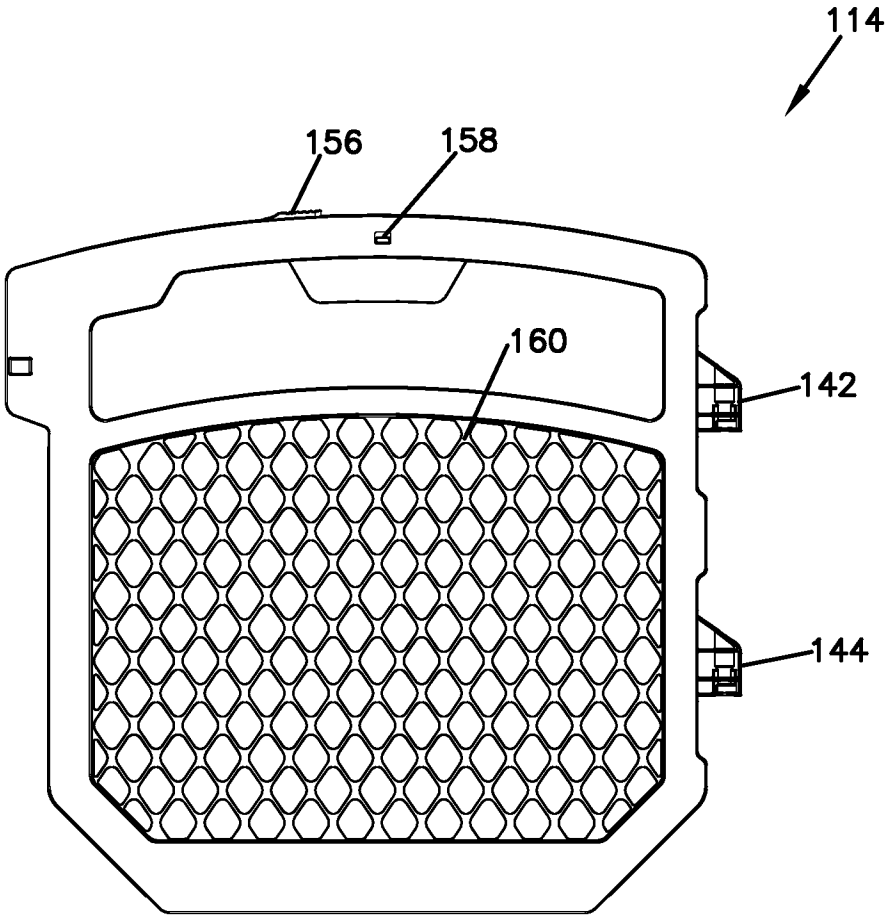
FIG. 11 is a front view of the gate of FIG. 9.
Figure 12:
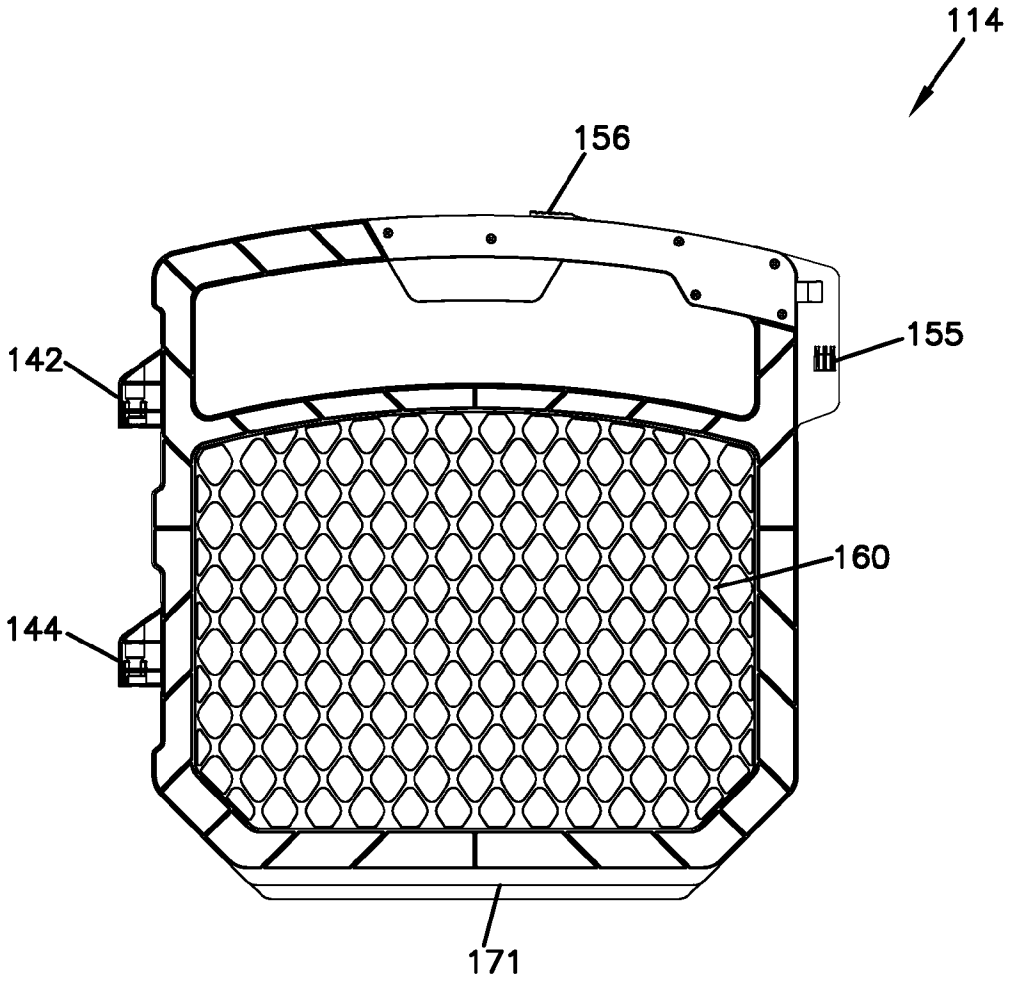
FIG. 12 is a back view of the gate of FIG. 9.
Figure 13:
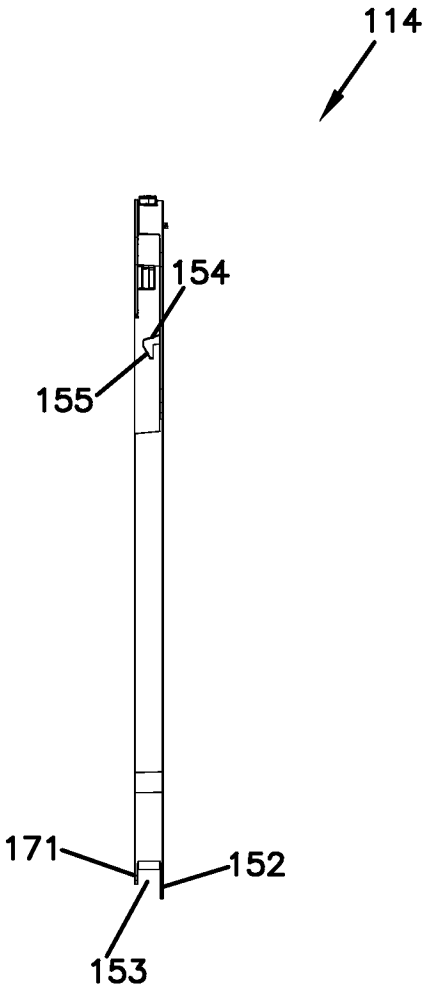
FIG. 13 is a first side view of the gate of FIG. 9.
Figure 14:
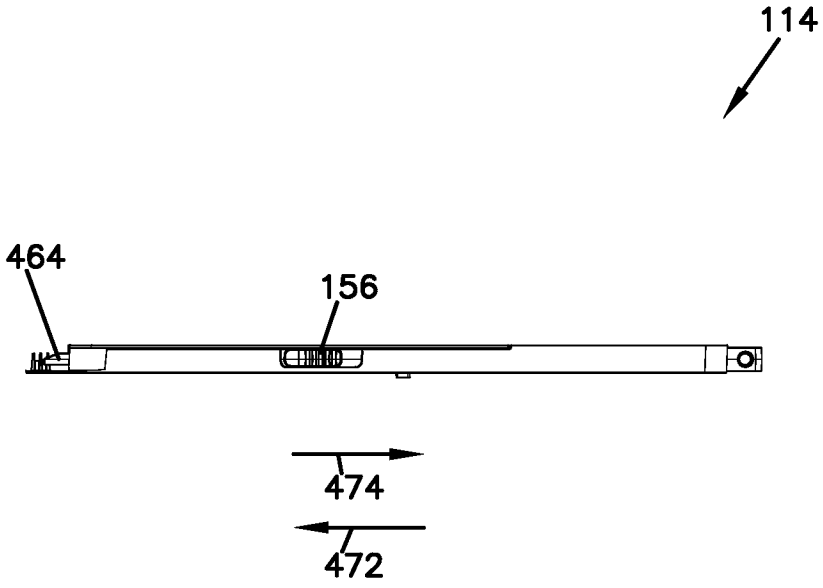
FIG. 14 is a top view of the gate of FIG. 9.
Figure 15:
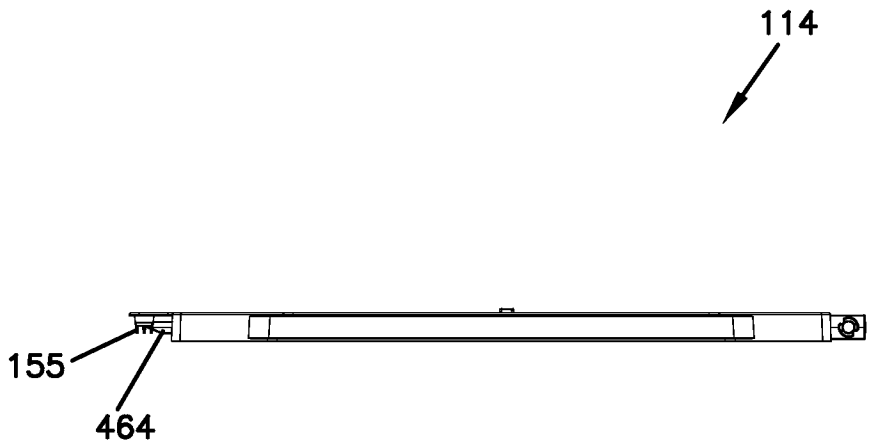
FIG. 15 is a bottom view of the gate of FIG. 9.
Figure 16:
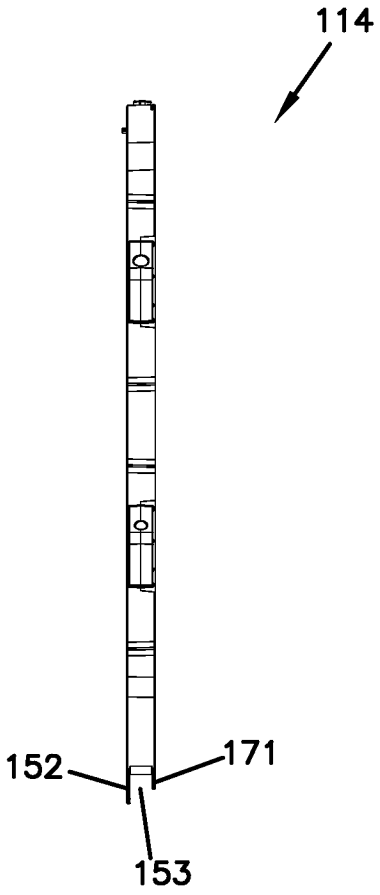
FIG. 16 is a second side view of the gate of FIG. 9.

Referring now to FIGS. 1-2, an example play yard 100 is shown. In this example, the play yard 100 includes a plurality of panels.

All but one of the panels in this example are identical and are referred to herein as side panels 110. There are five side panels 110 in the play yard 100. The side panels 110 are connected by hinges 116 and rods 118 to form five of the six sides of the play yard 100.

Figure 17:
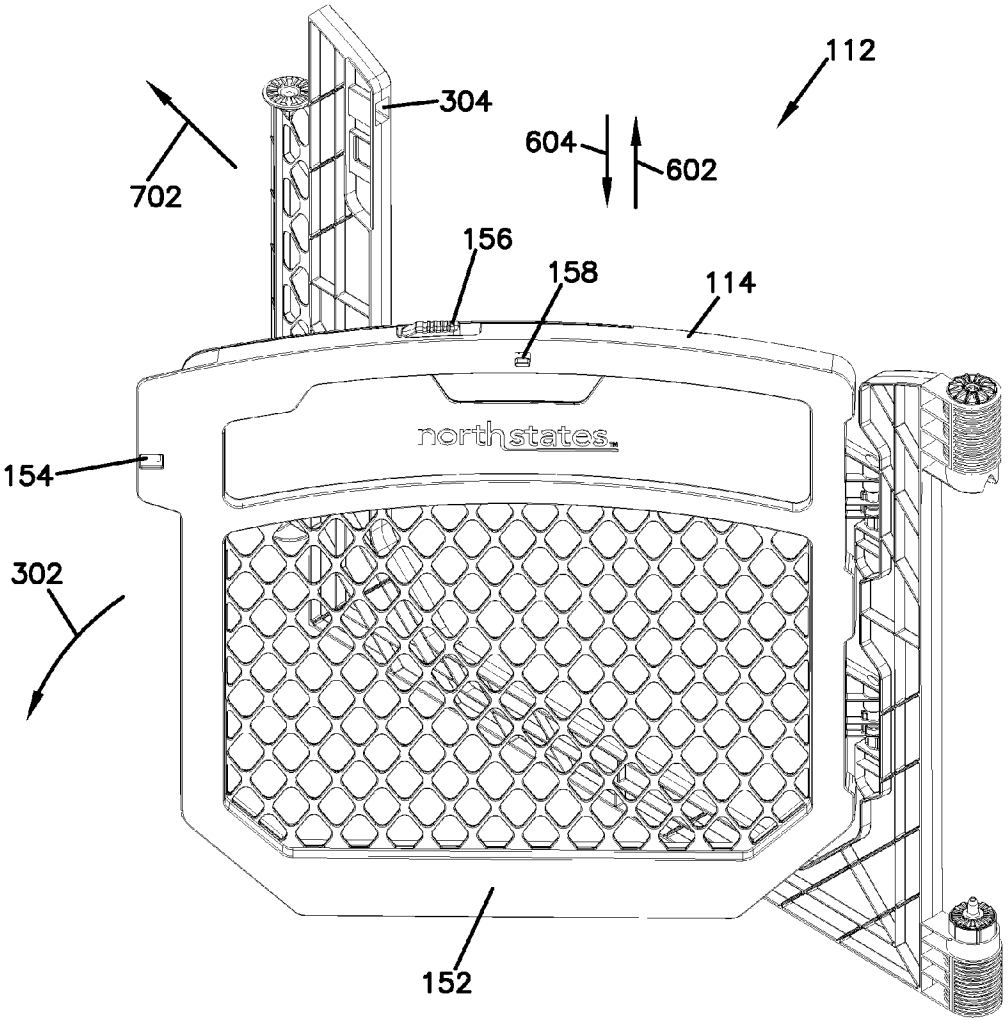
FIG. 17 is a front perspective view of the gate panel of FIG. 3 with the gate in the open position.
Figure 18:
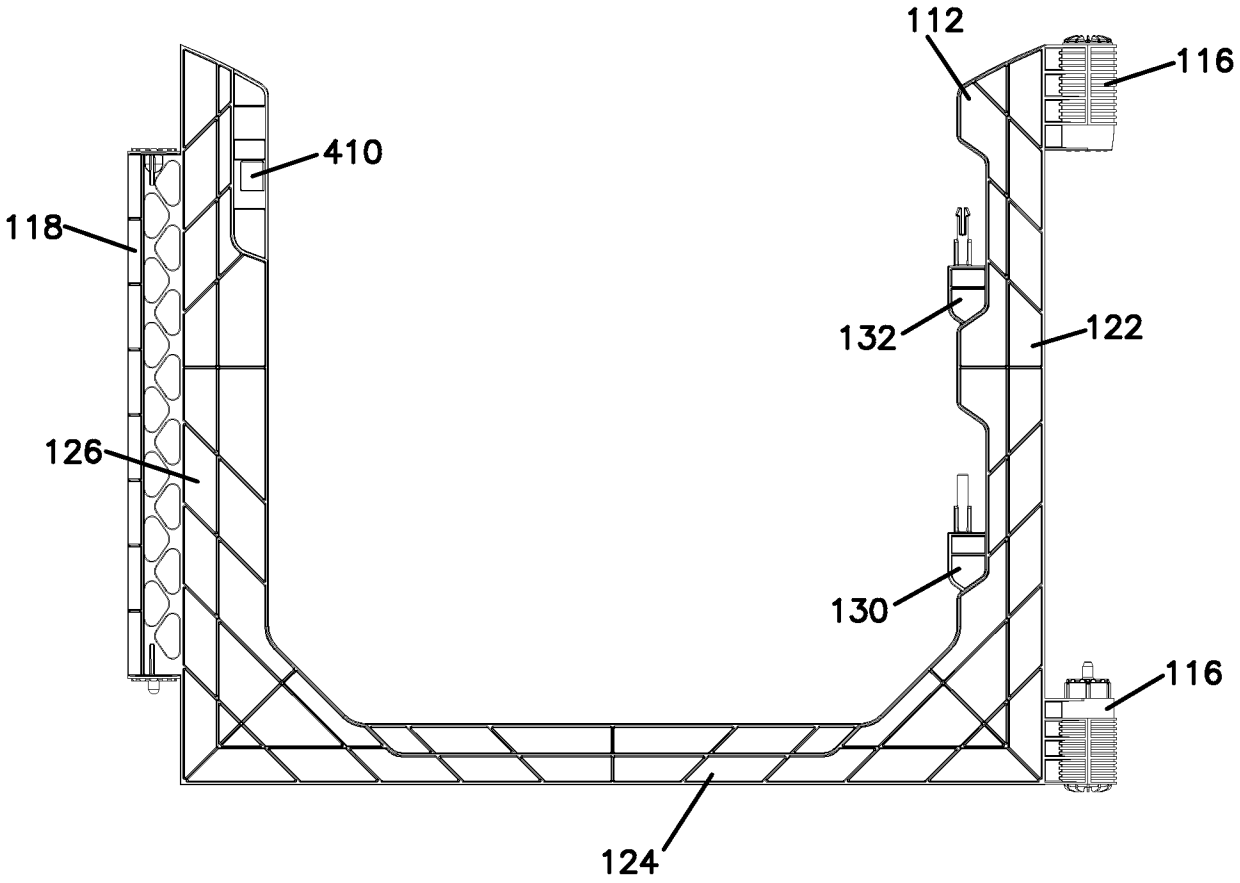
FIG. 18 is a front view of the gate panel of FIG. 3 with the gate removed.
Figure 19:
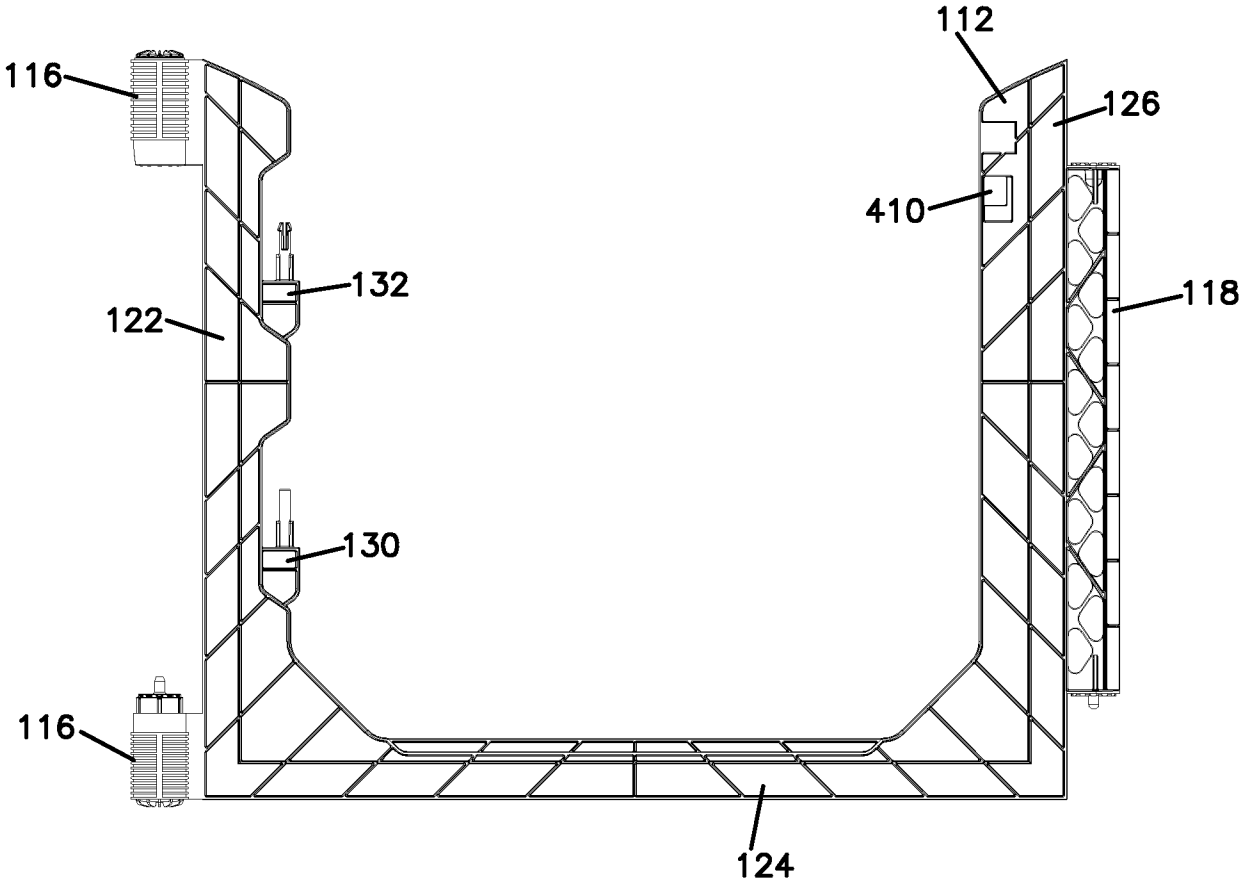
FIG. 19 is a back view of the gate panel of FIG. 18.
Figure 20:
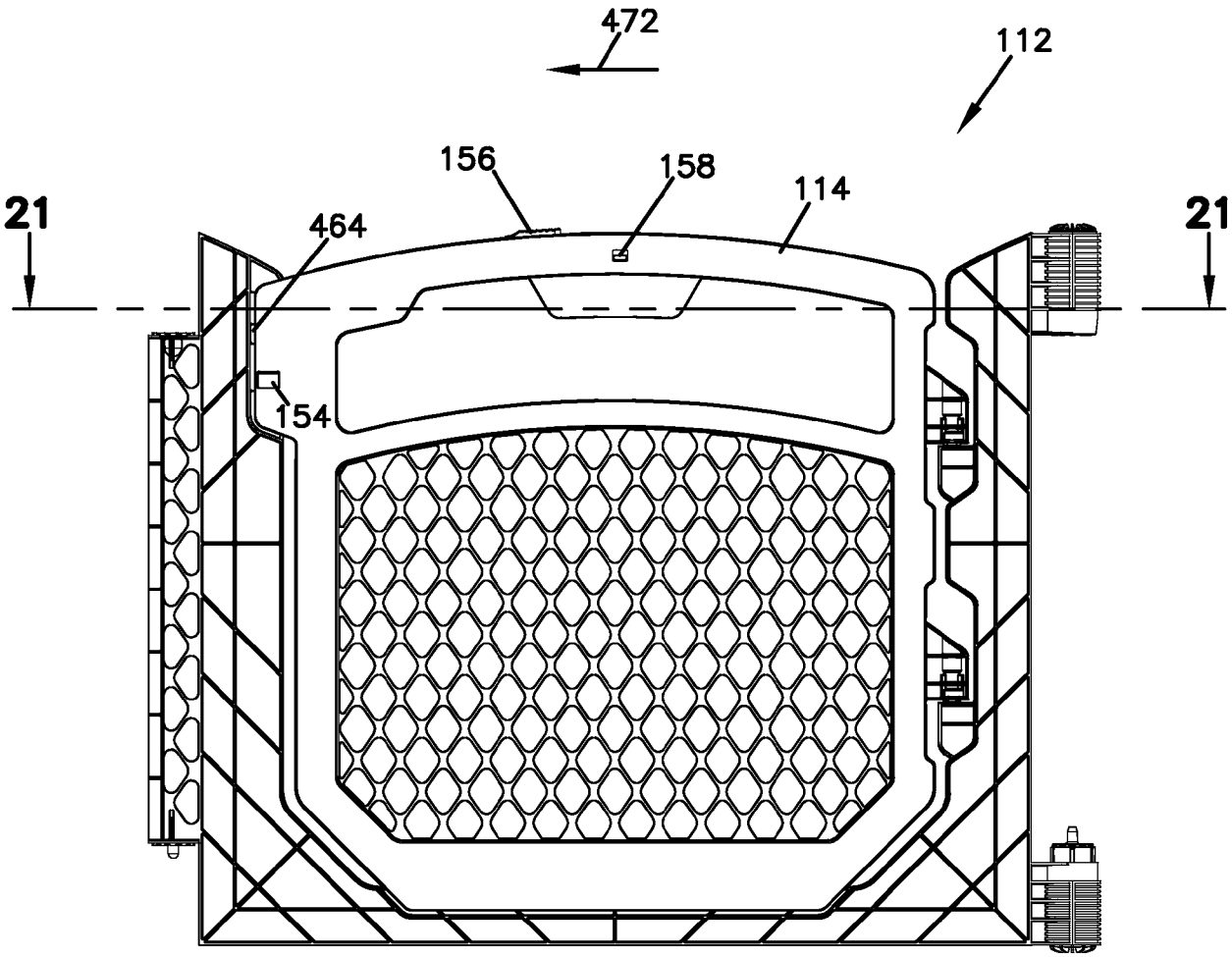
FIG. 20 is a front view of the gate panel of FIG. 3 with a locking mechanism in a closed position.
Figure 21:
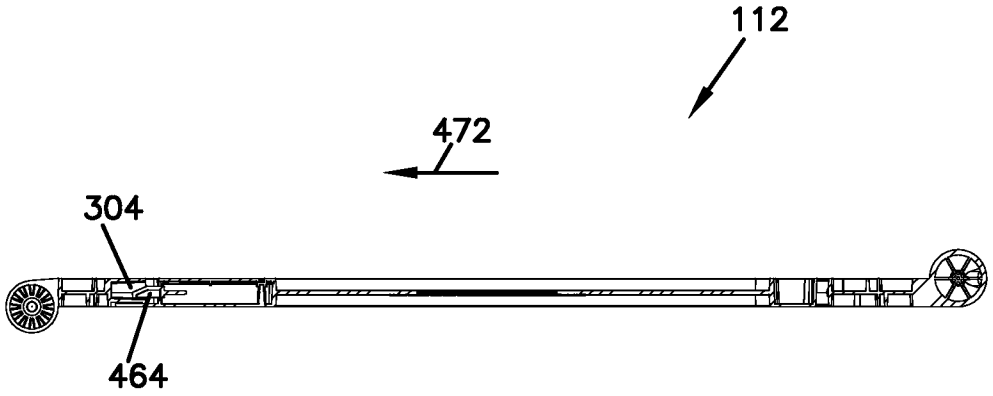
FIG. 21 is a cross-sectional view taken along line 21-21 of the gate panel of FIG. 20.
Figure 22:
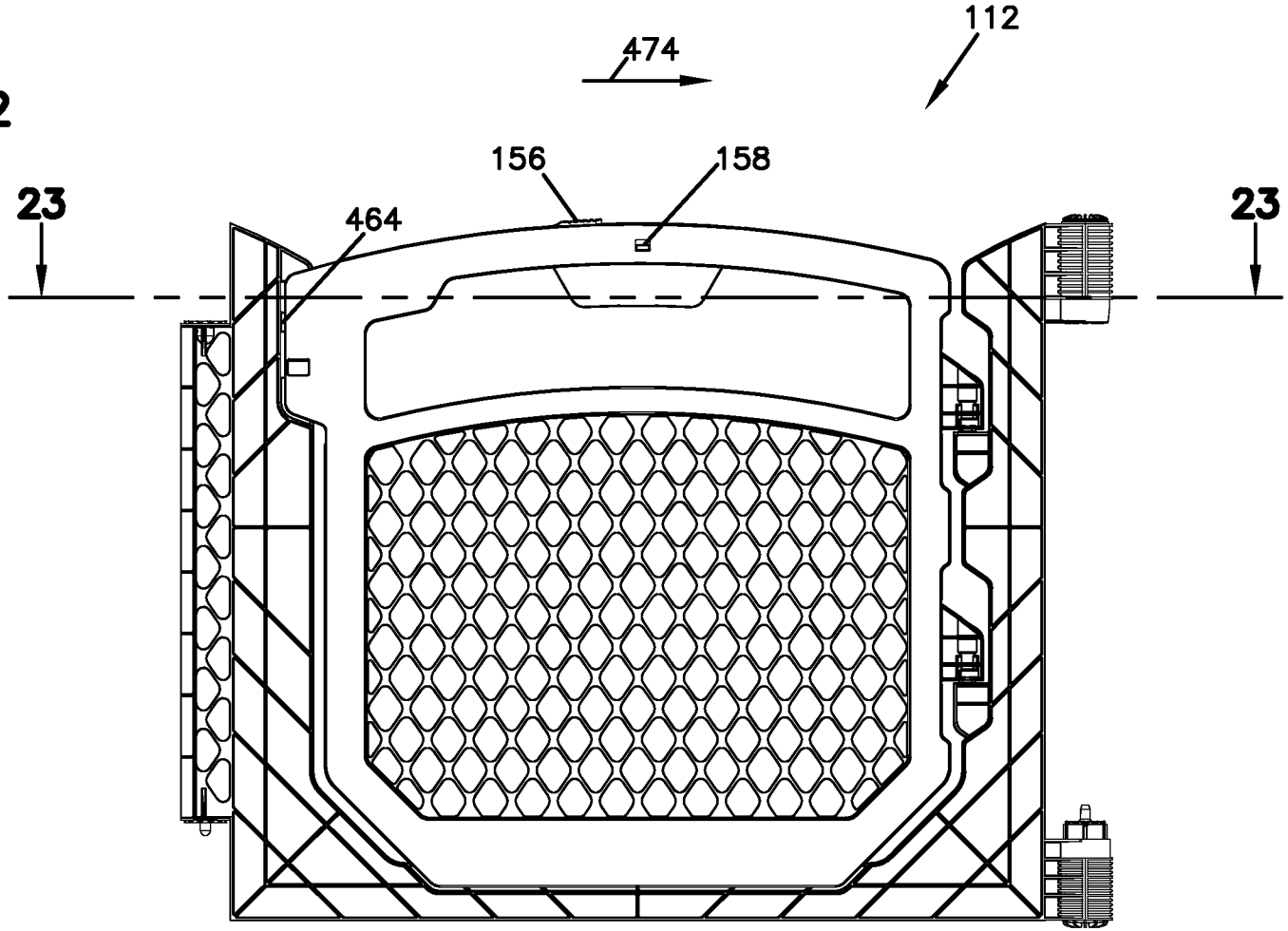
FIG. 22 is another front view of the gate panel of FIG. 3 with the locking mechanism in the open position.
Figure 23:
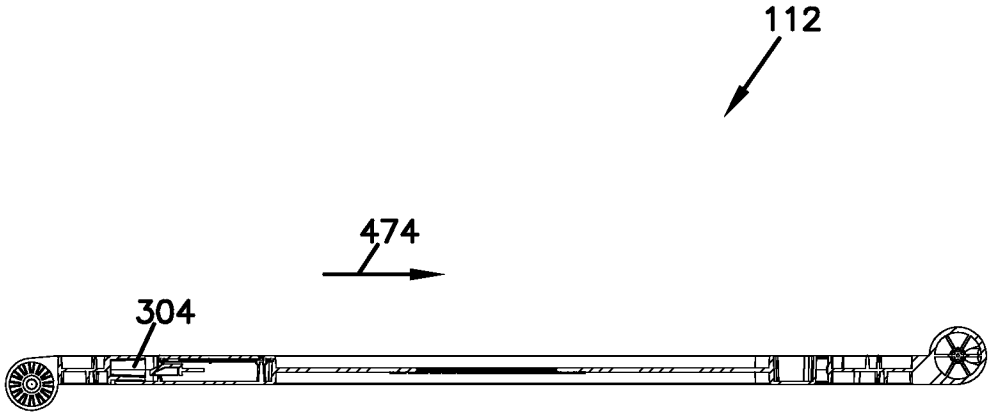
FIG. 23 is a cross-sectional view taken along line 23-23 of the gate panel of FIG. 22.

The other panel is similar to the side panels 110, except the panel includes a gate 114 and is referred to herein as a gate panel 112. The gate panel 112 connects to the other side panels 110 in a similar fashion. The gate 114 of the gate panel 112 pivots between a closed position (as shown in FIGS. 1-2) and an open position (as shown in FIG. 17).

The panels 110, 112 together form an enclosed space into which a child and/or animal can be placed for security and safety. In this example, the enclosed space is generally hexagonal in shape. In other examples, other numbers of panels and sizes/shapes of the enclosed space can be used.

The gate panel 112 can be used to access the enclosed space by opening the gate 114 to gain access into and out of the enclosed space formed by the panels 110, 112.

In examples, the play yard 100 is made of a plastic material, although other materials, such as wood or metal, can also be used.

Referring now to FIGS. 3-8, the gate panel 112 includes a base member 124 and side members 122, 126 that form an opening for the gate 114. The gate 114 is mounted to pivot members 130, 132 on the side member 122 so that the gate 114 can pivot between the closed and open positions.

Referring now to FIGS. 9-16, the gate 114 includes pivot members 142, 144 that engage the pivot members 130, 132 on the gate panel 112 to pivotally connect the gate 114 to the gate panel 112.

The gate 114 also includes a base member 152 defining a space 153 that engages the base member 124 when in the closed position, as described further below.

The gate 114 includes a first locking mechanism 154 including a hook member 155 sized to engage a window opening 410 on the gate panel 112 when in the closed position. The gate 114 includes a second locking mechanism 156 that moves between locked and unlocked positions to lock and unlock the gate 114 from the gate panel 112. Finally, a switch 158 moves between locked and unlocked positions to lock the second locking mechanism 156 so that the second locking mechanism 156 cannot be actuated when the switch 158 is in the locked position. Additional details on the first and second locking mechanisms 154, 156 and the switch 158 are shown in FIGS. 17-25, which are described further below.

The gate 114 includes a lattice structure 160 with a plurality of openings that allow the user to see through the lattice structure 160 into and out of the play yard 100.

Referring now to FIGS. 17-25, additional details on the first and second locking mechanisms 154, 156 are provided.

In FIG. 17, the gate 114 of the gate panel 112 has been pivoted from the closed position (see, e.g., FIGS. 1-8) to the open position in a direction 302. In order to move the gate 114 into this position, the switch 158 must be in the unlocked position, and the first and second locking mechanisms 154, 156 must be actuated.

Figure 24:
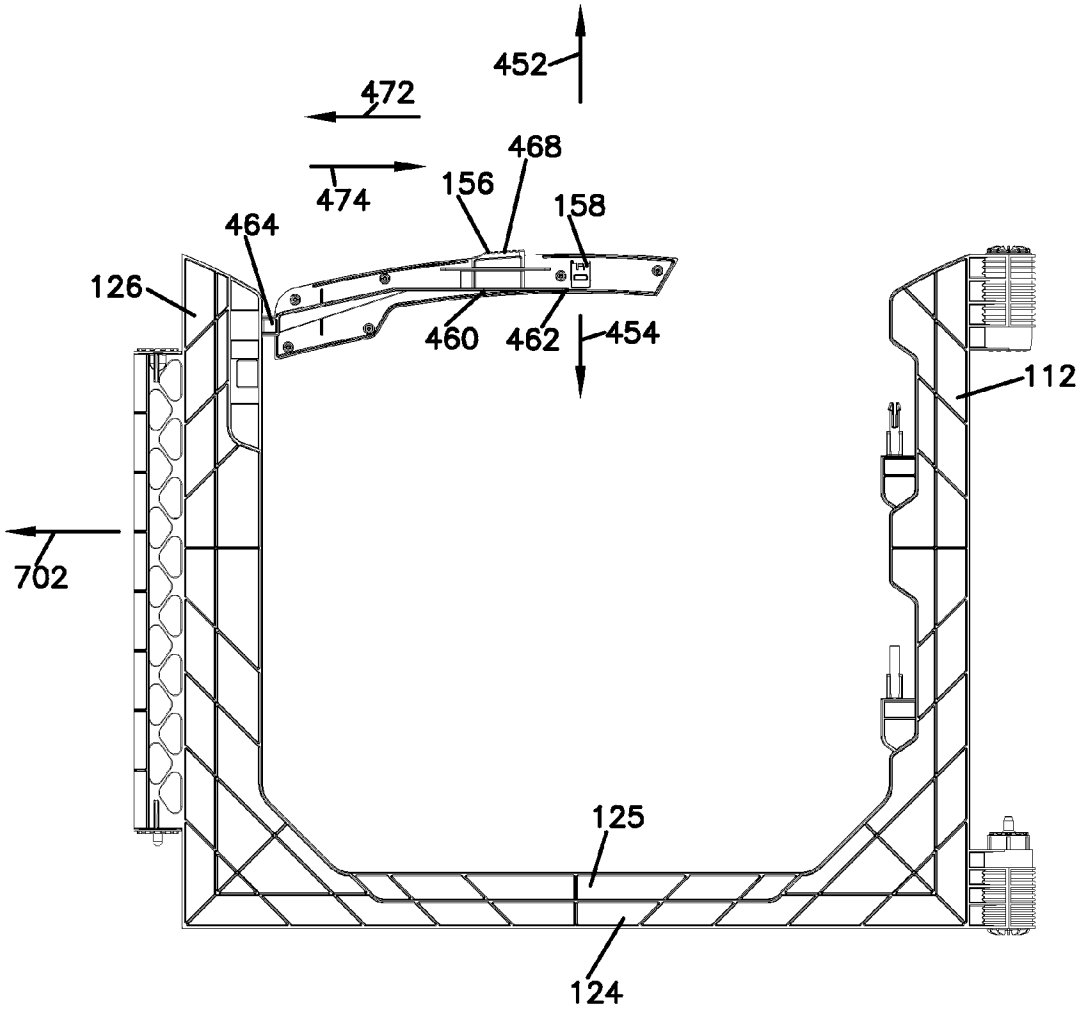
FIG. 24 is a front view of the gate panel of FIG. 3 with a portion of the gate removed to show the locking mechanism.
Figure 25:
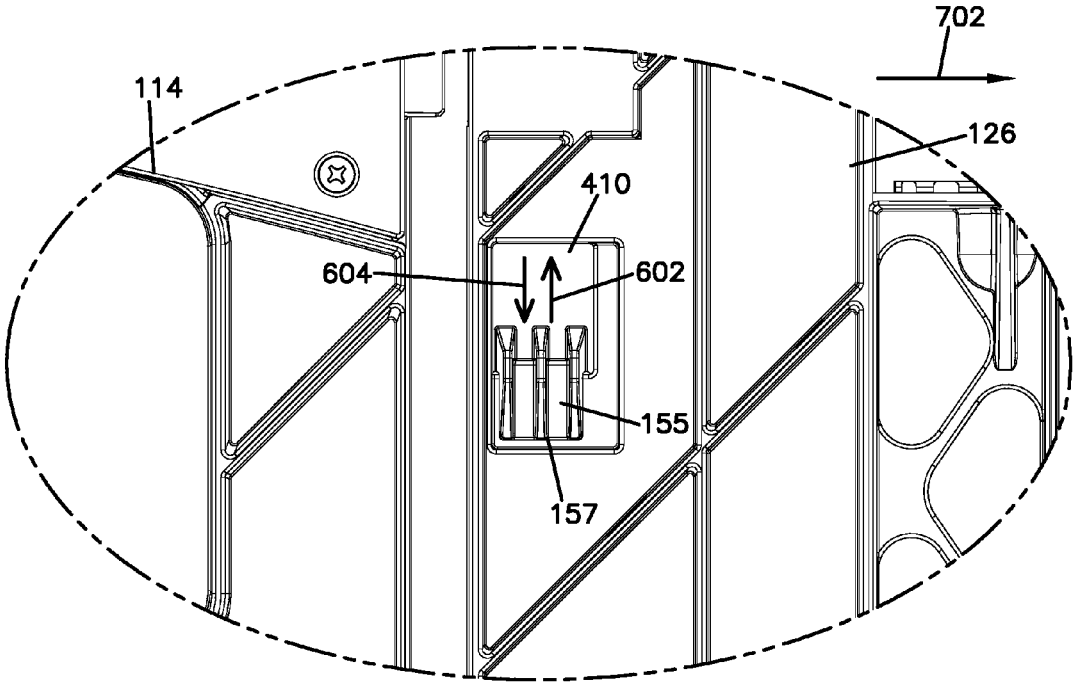
FIG. 25 is an enlarged portion of the gate panel shown in FIG. 8.

The switch 158 is shown in more detail in FIG. 24. In this example, the switch 158 moves in directions 452, 454. In the direction 452, the switch 158 is unlocked. In the direction 454, the switch 158 is locked, as shown in FIG. 24.

In the locked position, the switch 158 limits the travel of the second locking mechanism 156 in a direction 474 so that the second locking mechanism 156 remains locked with respect to the side member 126 of the gate panel 112.

Specifically, the second locking mechanism 156 includes a member 460 that extends from a handle portion 468 to a pin member 464 that engages a window 304 in the side member 126 (see FIGS. 17, 21, 23) to lock pivoting of the gate 114 relative to the gate panel 112 in the direction 302. An end 462 of the member 460 is stopped from moving in the direction 474 by the switch 158 when in the locked position (i.e., in direction 454) so that the pin member 464 cannot clear the window 304 on the side member 126, thereby retaining the gate 114 in the closed position. See FIGS. 20-21.

When the switch 158 is moved in the direction 452, the end 462 can thereupon clear the switch 158 to allow the second locking mechanism 156 to be moved in the direction 474 until the pin member 464 is completely removed from the window 304 in the side member 126, thereby unlocking the second locking mechanism 156. See FIGS. 22-23.

The second locking mechanism 156 is biased in the direction 472 into the locked position so that force must be applied to the handle portion 468 to move the second locking mechanism 156 in the direction 474 to unlock the second locking mechanism 156 to allow the gate 114 to be moved to the open position.

In addition, the hook member 155 of the first locking mechanism 154 engages the window opening 410 on the gate panel 112 to secure the gate 114 in the locked position. See FIG. 25. In this position, an end 157 of the hook member 155 extends below the window opening 410 so that the gate 114 cannot be moved in the direction 302 to open the gate 114.

In addition, the hook member 155, when positioned in the window opening 410, minimizes any tendency of the side member 126 to move or bow in a direction 702 away from the gate 114, which could result in the inadvertent disengagement of the pin member 464 of the second locking mechanism 156 from the window 304 in the side member 126. In this manner, the hook member 155 functions to maintain the gate 114 in the closed position should external forces be applied to the side member 126.

To open the gate 114, the gate 114, including the hook member 155, is lifted in a direction 602 until the end 157 of the hook member 155 clears the window opening 410, thereby allowing the hook member 155 to fit through the window opening 410 and the gate 114 to pivot in the direction 302. When the gate 114 is closed, the gate 114 is moved in a direction 604 by gravity to engage the hook member 155 with the window opening 410. The amount of force necessary to move the gate 114 in the direction 602 can be modified so that small children and animals cannot provide the necessary force, while adults can easily move the gate 114 in the necessary direction to unlock the gate 114.

Finally, in the closed position, the base member 152 of the gate 114 engages an edge 125 of the base member 124 of the gate panel 112 to resist movement of the gate 114 in the direction 302. Specifically, when closed, the space 153 formed by the base member 152 of the gate 114 engages the edge 125 of the base member 124 so that the bottom of the gate 114 resists movement in the direction 302. This can be important, for example, if small children or animals exert a force at the bottom of the gate 114.

Only when the gate 114 is lifted in the direction 602 does a back edge 171 of the base member 152 (see FIGS. 13 and 16) clear the base member 124 so that the gate 114 can be pivoted in the direction 302. In the closed position, gravity moves the gate 114 in the direction 604 so that the space 153 formed by the base member 152 of the gate 114 engages the base member 124. Again, the force needed to lift the gate in the direction 602 can be manipulated so that small children and animals cannot provide the needed force.

The steps necessary to open the gate 114 are as follows. Initially, switch 158 is moved in the direction 452 into the unlocked position, and the second locking mechanism 156 is moved in the direction 474 so that the pin member 464 clears the window 304 in the side member 126.

Next, the gate 114 is lifted in the direction 602 so that: (i) the hook member 155 clears the window opening 410, thereby allowing the hook member 155 to fit through the window opening 410; and (ii) the back edge 171 of the base member 152 clears the base member 124. In this configuration, the gate 114 can be pivoted in the direction 302 to the open position.

To again lock the gate 114, the second locking mechanism 156 is moved in the direction 474, and the gate 114 is pivoted until the hook member 115 is positioned through the window opening 410 and the space 153 formed by the base member 152 is positioned above the base member 124. In this configuration, the gate 114 is released, allowing the gate to move in the direction 604 so that the hook member 115 engages the window opening 410 and the base member 152 engages the base member 124 of the gate panel 112. In addition, the second locking mechanism 156 is biased back in the direction 472 so that the pin member 464 engages the window 304. Finally, the switch 158 can be moved in the direction 454 to resist inadvertent unlocking of the second locking mechanism 156.

Although the subject matter has been described in language specific to structural features and/or methodological acts, it is to be understood that the subject matter defined in the appended claims is not necessarily limited to the specific features or acts described above. Rather, the specific features and acts described above are disclosed as example forms of implementing the claims.

What is claimed is:

1. A play yard, comprising:

a plurality of side panels coupled to one another;

a gate panel coupled to two of the plurality of side panels to create a free-standing barrier forming an enclosed space within the plurality of side panels and the gate panel of the play yard;

a rod positioned on one of the plurality of side panels for connecting the one of the plurality of side panels to the gate panel;

the gate panel including:

a gate panel frame defining an opening, the gate panel frame including a gate panel base member, a first side member, and a second side member that form the opening, the gate panel base member extending between the first and second side members to define a bottom portion of the opening, the first side member having an inner edge and an outer edge, the outer edge of the first side member having the rod attached thereon, the rod coupling the first side member to one of the plurality of side panels;

a gate including a gate base member, the gate being mounted to the gate panel frame in the opening of the gate panel frame to swing above a portion of the gate panel base member from a closed position to an open position, the portion of the gate panel base member extending beneath a portion of the gate base member in a direction from the first side member toward the second side member when in the closed position, the inner edge of the first side member facing toward the gate positioned in the opening of the gate panel frame;

a first window and a second window adjacent the first window, the first and second windows each having a plurality of sides, one of the plurality of sides of each one of the first and second windows being respectively defined by the inner edge of the first side member of the gate panel frame;

a first locking mechanism on the gate, the first locking mechanism including a hook member stationarily positioned on the gate such that the hook member moves with the gate, and not independently of the gate, the hook member being sized to engage the first window to hold the gate in the closed position;

a second locking mechanism on the gate, the second locking mechanism including a member that extends from a handle portion to a moveable pin member, the handle portion being positioned to move the moveable pin member between a first laterally projected orientation and a second laterally retracted orientation;

when in the first laterally projected orientation, the moveable pin member projecting into the second window to lock the gate closed relative to the gate panel frame; and, when in the second laterally retracted orientation, the moveable pin member being retracted from the second window allowing the gate to be moved relative to the gate panel frame, provided the gate is lifted sufficiently to unlock the first locking mechanism; and a switch positioned on the gate, the switch being movable between a locked position and an unlocked position;

when the switch is in the locked position, the switch preventing the handle portion of the second locking mechanism from moving the moveable pin member to the second laterally retracted orientation such that the moveable pin member is prevented from disengaging the second window and the gate is locked closed relative to the gate panel frame; and, when the switch is in the unlocked position, the switch permitting the handle portion of the second locking mechanism to move the moveable pin member to the second laterally retracted orientation such that the moveable pin member of the second locking mechanism is retracted from the second window to allow the gate to be moved relative to the gate panel frame, provided the gate is lifted sufficiently to unlock the first locking mechanism.

2. The play yard of claim 1, wherein the play yard includes five side panels.

3. The play yard of claim 2, wherein each of the side panels is formed by a lattice structure.

4. The play yard of claim 1, wherein each of the side panels includes a hinge to connect a side panel to another of the side panels in a hinged arrangement.

5. The play yard of claim 1, wherein the gate base member defines a space, between portions of the gate base member, sized to receive at least the portion of the gate panel base member extending beneath the portion of the gate base member.

6. The play yard of claim 1, wherein the gate base member includes a first flange that extends a long a first side of the gate panel base member, and an opposite second flange that extends along a second side of the gate panel base member, the first and second flanges together defining a receiver with the gate panel base member extending therethrough to inhibit the gate from pivoting from the closed position to the open position.

7. The play yard of claim 6, wherein the play yard includes five side panels.

8. The play yard of claim 6, wherein each of the side panels includes a hinge to connect a side panel to another of the side panels in a hinged arrangement.

9. The play yard of claim 6, wherein the first flange extends further in a direction adjacent the gate panel base member in a direction away from a remainder of the gate base member than the second flange such that upon lifting the gate, the first flange is sufficiently short to clear the gate panel base member to allow the gate to swing to the open position, provided the gate is lifted sufficiently to unlock the first locking mechanism, without the second flange clearing the gate panel base member.

10. The play yard of claim 1, wherein the gate comprise wood.

11. The play yard of claim 1, wherein the gate comprise plastic.

12. The play yard of claim 1, wherein the gate comprise metal.

13. The play yard of claim 1, wherein the gate comprises first and second pivot devices.

14. The play yard of claim 13, wherein the second side member includes first and second pivot members.

15. The play yard of claim 14, wherein the first and second pivot devices of the gate engage the first and second pivot members of the second side member, respectively, to pivotally connect the gate to the gate panel.

16. A method for using a play yard, the method comprising:

assembling a plurality of side panels and a gate panel including a gate to form a free-standing barrier forming an enclosed space within the plurality of side panels and the gate panel of the play yard, the gate panel including a gate panel frame defining an opening, the gate panel frame having a gate panel base member, a first side member, and a second side member that form the opening, the gate panel base member extending between the first and second side members to define a bottom portion of the opening, the first side member having an inner edge and an outer edge, the gate panel including adjacent first and second windows, the first and second windows each having a plurality of sides, one of the plurality of sides of each one of the first and second windows being respectively defined by the inner edge of the first side member of the gate panel frame;

moving a switch along a first direction from a locked position to an unlocked position;

sliding a second locking mechanism from a first laterally projected orientation to a second laterally retracted orientation such that a moveable pin member of the second locking mechanism is retracted from the second window of the first side member of the gate panel frame to unlock the gate relative to the gate panel frame;

lifting the gate sufficiently to disengage a hook member of a first locking mechanism from the first window of the first side member of the gate panel frame to allow the gate to be moved relative to the gate panel frame, the hook member being stationarily positioned on the gate such that the hook member moves with the gate, and not independently of the gate; and swinging the gate above a portion of the gate panel base member from a closed position to an open position.

17. The method of claim 16, further comprising attaching each of the side panels to another side panel using a hinge.

18. A play yard, comprising:

a plurality of side panels coupled together; and a gate panel coupled to two of the plurality of side panels to create a free-standing barrier, the gate panel including a gate panel base member, a first side member, and a second side member that together form an opening, the gate panel base member extending between the first and second side members to define a bottom portion of the opening, the gate panel including:

a gate including a gate base member, the gate being mounted to the gate panel in the opening of the gate panel to swing above a portion of the gate panel base member from a closed position to an open position, the portion of the gate panel base member extending beneath a portion of the gate base member in a direction from the first side member toward the second side member when in the closed position;

a first locking mechanism on the gate, the first locking mechanism including a hook member stationarily positioned on the gate such that the hook member moves with the gate, and not independently of the gate, the hook member being sized to engage a first window defined by the first side member of the gate panel frame to hold the gate in the closed position;

a second locking mechanism on the gate, the second locking mechanism including a member that extends from a handle portion to a moveable pin member, the handle portion being positioned to move the moveable pin member between a first laterally projected orientation and a second laterally retracted orientation;

when in the first laterally projected orientation, the moveable pin member projecting into the first side member to lock the gate closed relative to the gate panel frame; and, when in the second laterally retracted orientation, the moveable pin member being retracted from the first side member allowing the gate to be moved relative to the gate panel frame provided the gate is lifted sufficiently to unlock the first locking mechanism; and, a switch positioned on the gate, the switch being movable between a locked position and an unlocked position;

when the switch is in the locked position, the switch preventing the handle portion of the second locking mechanism from moving the moveable pin member to the second laterally retracted orientation such that the moveable pin member is prevented from disengaging the first side member and the gate is locked closed relative to the gate panel frame; and, when the switch is in the unlocked position, the switch permitting the handle portion of the second locking mechanism to move the moveable pin member to the second laterally retracted orientation such that the moveable pin member of the second locking mechanism is retracted from the first side member to allow the gate to be moved relative to the gate panel frame and swing to the open position, provided the gate is lifted sufficiently to unlock the first locking mechanism;

the gate base member including:

a first flange that extends along a first side of the gate panel base member when the gate is in the closed position; and, an opposite second flange that extends along a second side of the gate panel base member when the gate is in the closed position, the first and second flanges together defining a receiver with the gate panel base member extending therethrough to inhibit the gate from pivoting from the closed position to the open position;

wherein the first flange extends further in a direction adjacent the gate panel base member in a direction away from a remainder of the gate base member than the second flange such that upon lifting the gate, the first flange is sufficiently short to clear the gate panel base member to allow the gate to swing to the open position, provided the gate is lifted sufficiently to unlock the first locking mechanism, without the second flange clearing the gate panel base member.

* * * * *